US010219675B2

(12) United States Patent
Aras et al.

(10) Patent No.: US 10,219,675 B2
(45) Date of Patent: Mar. 5, 2019

(54) DISHWASHER WITH AN ION GENERATOR TO MITIGATE BAD ODOURS

(75) Inventors: Nasir Efe Aras, Istanbul (TR); Orhan Atabey, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 1088 days.

(21) Appl. No.: 13/519,126

(22) PCT Filed: Dec. 16, 2010

(86) PCT No.: PCT/EP2010/069842

§ 371 (c)(1), (2), (4) Date: Aug. 16, 2012

(87) PCT Pub. No.: WO2011/076648

PCT Pub. Date: Jun. 30, 2011

(65) Prior Publication Data

US 2013/0133707 A1 May 30, 2013

(30) Foreign Application Priority Data

Dec. 25, 2009 (TR) ..... a 2009 09817

(51) Int. Cl.
*A47L 15/48* (2006.01)
*A47L 15/42* (2006.01)

(52) U.S. Cl.
CPC ..... *A47L 15/48* (2013.01); *A47L 15/4276* (2013.01); *A47L 15/488* (2013.01)

(58) Field of Classification Search
CPC ..... A47L 15/4276; A47L 15/0015; A47L 15/0036; A47L 15/4236; A47L 15/4238; A47L 15/424; A47L 15/4242; A47L 15/488; A47L 1501/16; A47L 2501/10; A47L 15/48; A47L 15/486; A47L 2501/12; A47L 2501/16; A47L 2601/06; A47L 2601/08; A47L 2601/10; D06F 35/008

See application file for complete search history.

(56) References Cited

U.S. PATENT DOCUMENTS

2003/0221709 A1* 12/2003 Jung et al. ..... 134/18
2007/0102025 A1* 5/2007 Ahn ..... A47L 15/0002 134/25.2
2007/0131259 A1* 6/2007 Classen ..... 134/56 D
(Continued)

FOREIGN PATENT DOCUMENTS

CN 1279051 A 1/2001
DE 3921177 A1 1/1991
(Continued)

OTHER PUBLICATIONS

JP2004351012—Machine Translation, Dec. 2004.*
(Continued)

*Primary Examiner* — Marc Lorenzi
(74) *Attorney, Agent, or Firm* — Kilpatrick Townsend & Stockton LLP

(57) ABSTRACT

The present invention relates to a dishwasher (1) comprising a tub (2) wherein the items to be washed are placed and a door (3) providing access to the tub (2), and wherein formation of unpleasant odor in the tub (2) is prevented by way of air within the tub being circulated through an ion generator.

13 Claims, 4 Drawing Sheets

(56) References Cited

U.S. PATENT DOCUMENTS

| | | | | |
|---|---|---|---|---|
| 2008/0011329 | A1 | 1/2008 | Classen et al. | |
| 2008/0283099 | A1 * | 11/2008 | Peukert | A47L 15/4291 134/99.1 |
| 2010/0282280 | A1 | 11/2010 | Usta Yogun et al. | |

FOREIGN PATENT DOCUMENTS

| | | | | | |
|---|---|---|---|---|---|
| DE | 102005058662 | A1 | | 6/2007 | |
| DE | 102008025204 | A1 | | 12/2009 | |
| EP | 2515737 | B1 | | 11/2013 | |
| JP | 2003144372 | A | * | 5/2003 | |
| JP | 2004351012 | A | | 12/2004 | |
| JP | 2005143881 | A | | 6/2005 | |
| KR | 20060114100 | A | * | 11/2006 | |
| KR | 100816907 | B1 | * | 3/2008 | |
| KR | 20100094387 | A | * | 8/2010 | |
| KR | 101192194 | B1 | * | 10/2012 | |
| WO | 2006061281 | A1 | | 6/2006 | |
| WO | WO 2009021973 | A1 | * | 2/2009 | A47L 15/42 |
| WO | 2009083391 | A1 | | 7/2009 | |

OTHER PUBLICATIONS

KR100816907—Machine Translation, Mar. 2008.*
KR101192194—Machine Translation, Oct. 2012.*
KR20100094387—Machine Translation, Aug. 2010.*
JP2003144372—Machine Translation, May 2003.*
International search report and written opinion, dated Apr. 15, 2011, of International Application No. PCT/EP2010/069842; 10 pgs.

* cited by examiner

DISHWASHER WITH AN ION GENERATOR TO MITIGATE BAD ODOURS

FIELD

The present invention relates to a dishwasher wherein the unpleasant odors forming therein are removed.

BACKGROUND

Before washing if the waiting period of the dishes inside the dishwashers is long, an undesired odor occurs inside the tub due to the microorganisms forming on the dishes. When the door of the dishwasher kept generally closed is opened to add dishes therein, the odor spreads unpleasantly into the environment.

In the state of the art Japanese Patent Application No. JP2004351012, a dishwasher is described wherein an ion generator is used to create sufficient hygiene conditions in the tub.

The aim of the present invention is the realization of a dishwasher wherein the unpleasant odors formed by the dishes kept in the tub to be washed are removed.

SUMMARY

The dishwasher realized in order to attain the aim of the present invention and explicated in the claims comprises a tub wherein the items to be washed are placed, an air channel both ends of which opens into the tub, an ion generator disposed in the air channel and at least one fan providing the air circulation between the air channel and the tub. The air inside the tub is sucked by means of the inlet of the air channel by the fan being operated. When the sucked air passes through the ion generator in the air channel, the air is provided to be cleaned by neutralizing the unpleasant odor molecules in the air. The air passing through the ion generator returns into the tub by means of the outlet. Thus, the foul air sucked from the tub is cleaned from unpleasant odors by means of the ion generator and returned into the tub. Thus, unpleasant odors forming especially due to dishes kept inside the tub for a long time are removed, and the user is prevented from being disturbed.

In an embodiment of the present invention, the air channel is on the door. The inlet and the outlet of the air channel are positioned on the inner surface of the door such as to face inside of the tub. Thus, the operations of sucking the foul air and dispersing the clean air into the tub are performed homogeneously.

In another embodiment of the present invention, the air channel is on one of the side walls of the tub.

In a version of this embodiment, the fan is located on the inlet of the air channel. Thus, the mounting of the fan on the channel is facilitated and the air suction efficiency is increased.

In another embodiment of the present invention, the dishwasher comprises an additional channel with one end opening to the air channel, the other to the outer environment and a valve located between the air channel and the additional channel. The additional channel provides the vapor sucked from the tub by means of the inlet during the drying operation to be discharged to the outer environment. The valve provides the air sucked from the tub to be directed to the additional channel during the drying operation and to move through the air channel such as to be directed to the ion generator during the odor removal operation and to return to the tub. The same fan is used in the drying operation and the odor removal operation. Both operations are performed in a controlled manner by means of the additional channel and valve structure. Cost savings are provided by using a single fan in drying operation and odor removal operation.

In another embodiment of the present invention, the dishwasher comprises an additional channel with one end connected to the air channel and the other opening to the outer environment and a deflector located between the air channel and the additional channel. By means of the deflector, in drying and odor removal operations, a portion of the air sucked from the tub and directed to the air channel is directed towards the ion generator and another portion towards the additional channel. The air directed to the ion generator is cleaned from unpleasant odors by being passed through the ion generator and is delivered into the tub again. The air directed to the additional channel is discharged to the outer environment.

In another embodiment of the present invention, the dishwasher comprises a control unit executing the odor removal operation by operating the fan at the end of the washing cycles the number of which is predetermined by the producer. Thus, unpleasant odors forming in the tub are removed at certain intervals.

In another embodiment of the present invention, the control unit realizes an odor removal program executed independently of the washing cycle. The odor removal program executed by the control unit is selected by means of the user interface. Thus, the user provides unpleasant odors inside the tub to be removed by starting the odor removal program when desired.

By means of the present invention, unpleasant odors forming due to the dishes being kept inside the tub for a long time are removed, and the user is prevented from being disturbed by the unpleasant odors A dishwasher realized in order to attain the aim of the present invention is illustrated in the attached figures, where,

DETAILED DESCRIPTION

Figure 1:
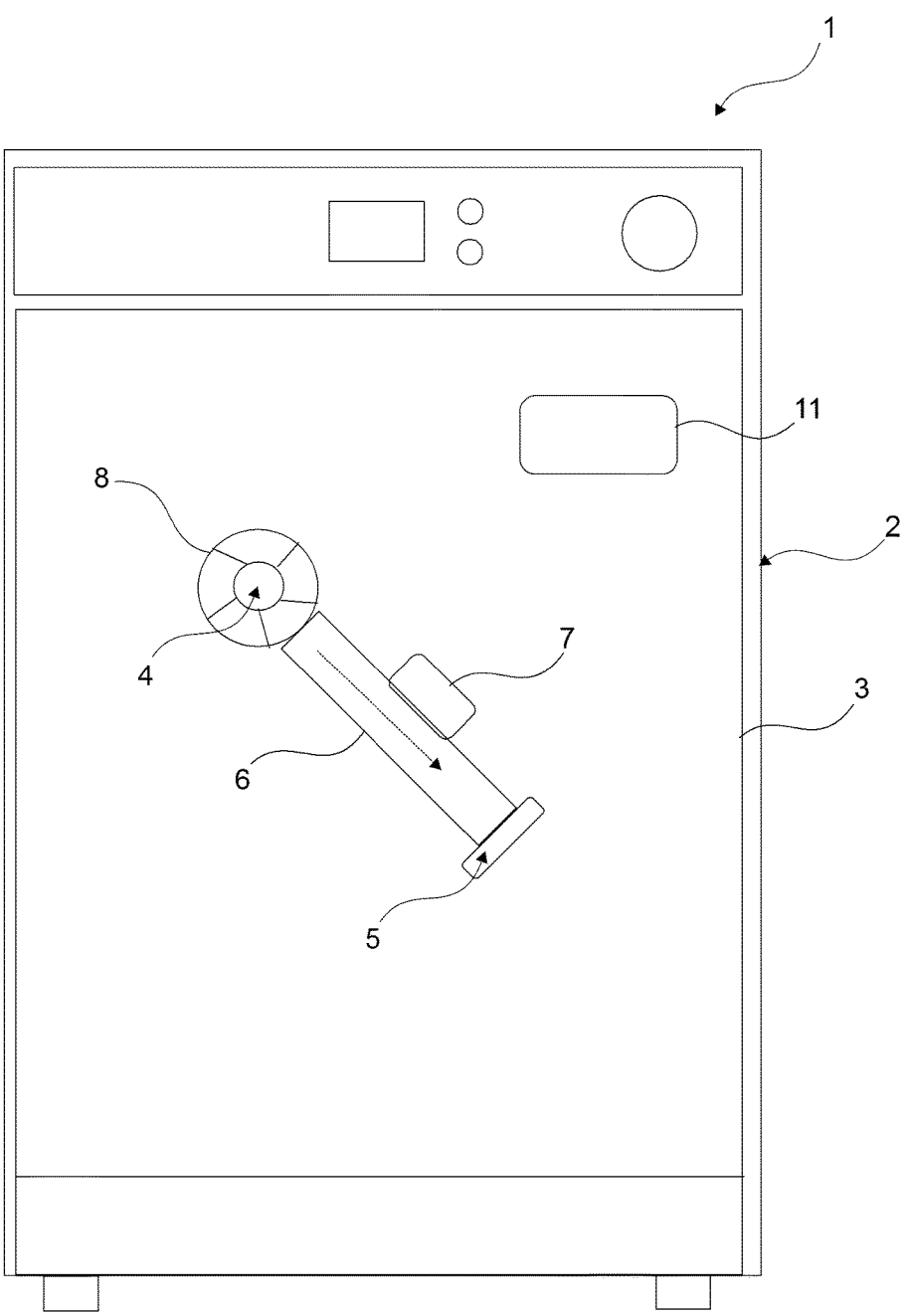
FIG. 1—is the schematic view of the inside of a door when the door is open.
Figure 2:
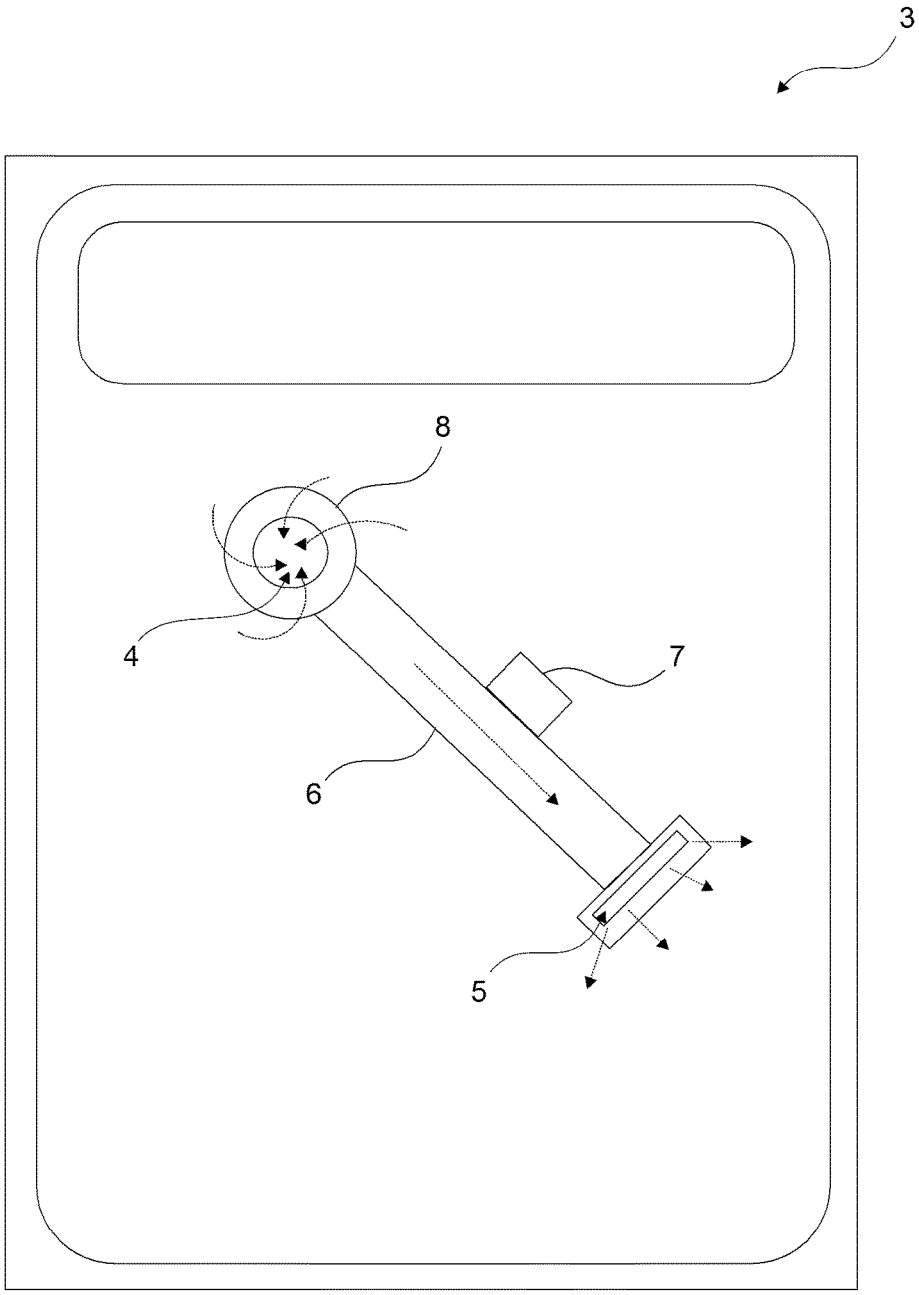
FIG. 2—is the sideways schematic view of a dishwasher relating to an embodiment of the present invention.
Figure 3:
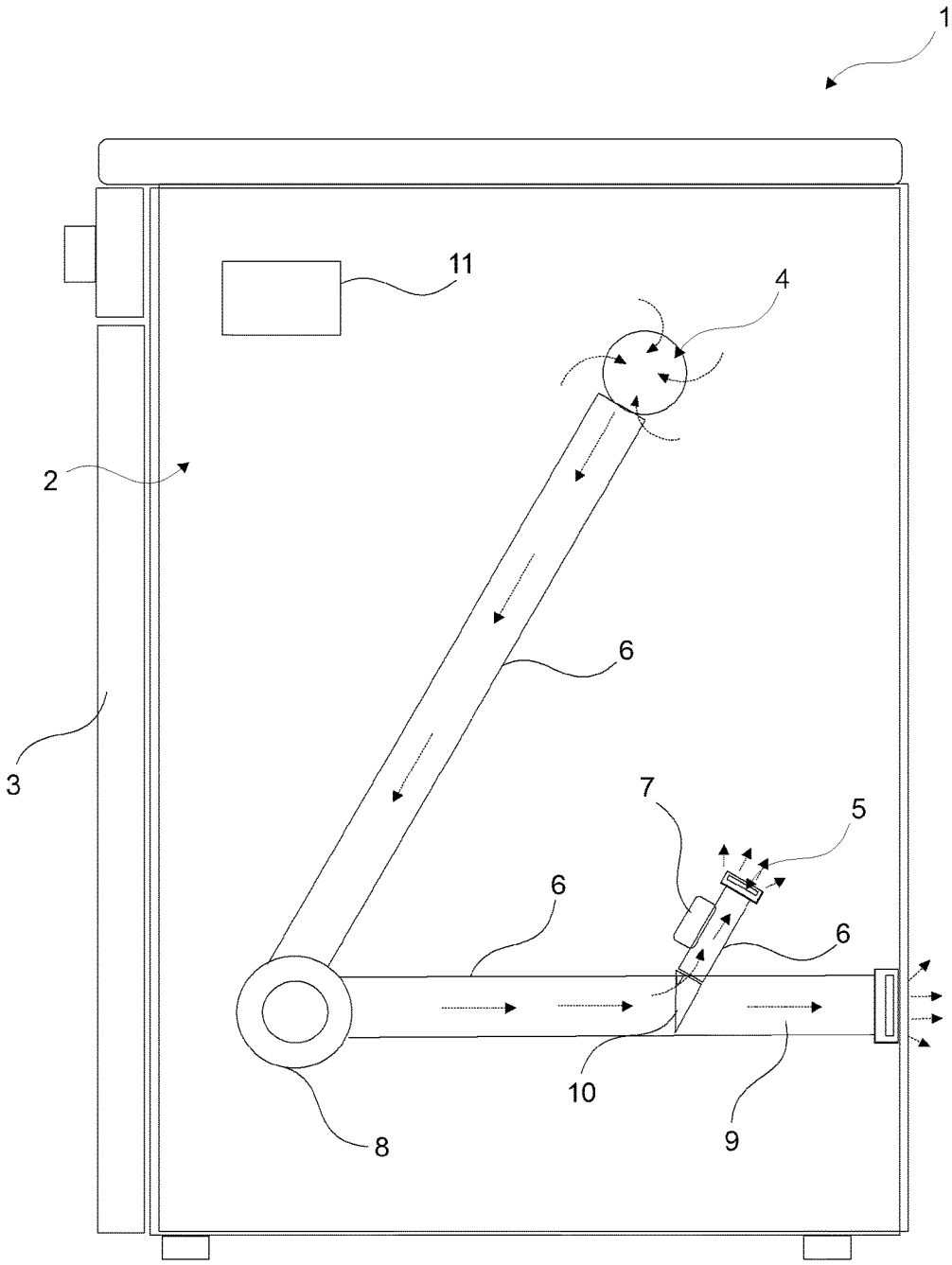
FIG. 3—is the sideways schematic view of a dishwasher relating to another embodiment of the present invention.

The elements illustrated in the figures are numbered as follows:

1. Dishwasher
2. Tub
3. Door
4. Inlet
5. Outlet
6. Air channel
7. Ion generator
8. Fan
9., 109 Additional channel
10. Valve
11. Control unit
12. Deflector The dishwasher (1) of the present invention comprises a tub (2) wherein the items to be washed are placed and a door (3) providing access into the tub (2), an air channel (6)

having an inlet (4) opening into the tub (2) and an outlet (5) opening into the tub (2), an ion generator (7) located inside the air channel (6) and a fan (8) providing the air circulation between the tub (2) and the air channel (6) (FIG. 1, FIG. 2 and FIG. 3).

The air inside the tub (2) is sucked from the inlet (4) of the air channel (6) by the fan (8) being operated. The ion generator (7) is operated together with the fan (8). The sucked air passes over the ion generator (7). While the air is passing over the ion generator (7), the effect of unpleasant odor molecules in the air is eliminated. The air passed over the ion generator (7) and wherein there is no unpleasant odor molecule is delivered again into the tub (2) by means of the outlet (5). By means of the air cleaned from unpleasant odors being directed into the tub (2), the air inside the tub (2) is also provided to be cleaned. Thus, unpleasant odors forming inside the tub (2) due to dirty dishes kept therein are removed. The air inside the tub (2) is provided to be cleaned by means of the odor removal operation executed as closed cycle based on the principal of directing the foul air sucked from the tub (2) after being cleaned from unpleasant odors into the tub (2) again. Thus, the problem of foul air spreading when the user opens the door (3) is prevented and the user is provided from being disturbed.

In an embodiment of the present invention, the air channel (6) is located on the door (3). The inlet (4) and the outlet (5) of the air channel (6) are positioned on the door (3) such as to interact with the tub (2) (FIG. 1 and FIG. 2). The fan (8) is located between the inlet (4) and the ion generator (7). The air inside the tub (2) is sucked by means of the inlet (4) as the fan (8) is operated. After the foul odor molecules in the sucked air are removed by the ion generator (7), the air is directed to the tub (2) by means of the outlet (5).

In a version of this embodiment, the fan (8) is placed on the inlet (4) of the air channel (6). Consequently, the sucking efficiency of the fan (8) is increased.

In another embodiment of the present invention, the air channel (6) is located on the tub (2) side wall.

In another embodiment of the present invention, the dishwasher (1) comprises an additional channel (9) with one end connected to the air channel (6), the other opening to the outer environment and a valve (10) located between the air channel (6) and the additional channel (9) (FIG. 3). The valve (10) directs the air in the air channel (6) towards the additional channel (9) during the drying operation and during the odor removal operation, directs the air in the air channel (6) towards the ion generator (7). By means of the valve (10), the operation of directing the air sucked from the tub (2) to the additional channel (9) or to the ion generator (7) is realized in a controlled manner.

The air inside the tub (2) is heated during the drying operation; the vapor inside the tub (2) is sucked by means of the inlet (4) as the fan (8) is operated. The air sucked by means of the inlet (4) passes to the air channel (6). The valve (10) provides the vapor inside the air channel (6) to be directed to the additional channel (9). The air passing to the additional channel (9) is discharged from the end of the additional channel (9) opening to the outside. Thus, the operation of drying the dishes washed is completed.

When the unpleasant odors in the tub (2) are desired to be removed, the air inside the tub (2) is sucked by means of the inlet (4) as the fan (8) is operated. During the odor removal operation, the air inside the air channel (6) is directed towards the ion generator (7) by breaking the connection between the air channel (6) and the additional channel (9) by means of the valve (10). The foul air passed over the ion generator (7) is delivered again into the tub (2) by means of the outlet (5) by being cleaned from unpleasant odors. Thus, unpleasant odors forming inside the tub (2) are removed.

By means of the additional channel (9) and the valve (10), the same inlet (4) and the same fan (8) are used during the drying operation and also the odor removal operation. Performing the drying operation and removing the odor in the tub (2) by using a single fan (8) eliminates the need for using a second fan (8) for these operations and provides cost advantage. Similarly, using the inlet (4) for sucking air from the tub (2) during the drying operation and also the odor removal operation prevents losses that may occur in terms of sound and heat insulation by eliminating the need for opening a second inlet (4).

Figure 4:
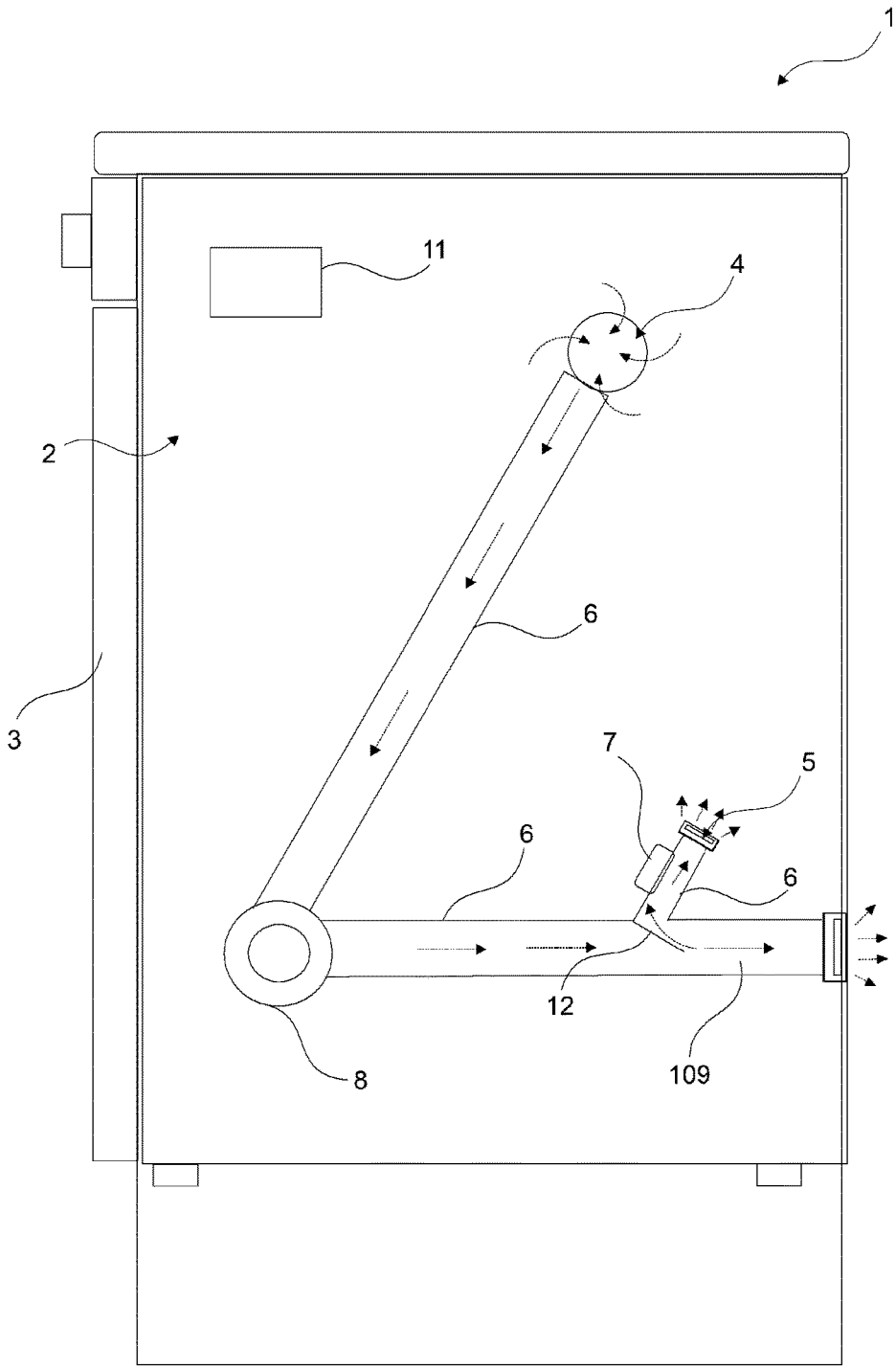
FIG. 4—is the sideways schematic view of a dishwasher relating to another embodiment of the present invention.

In another embodiment of the present invention, the dishwasher (1) comprises an additional channel (109) with one end connected to the air channel (6), the other opening to the outer environment and a deflector (12) located between the air channel (6) and the additional channel (109) (FIG. 4). The deflector (12) provides a portion of the air that is sucked by means of the inlet (4) and that passes to the air channel (6) to be directed towards the ion generator (7) and a portion to be directed to the additional channel (109) during the drying and the odor removal operations. The air directed towards the ion generator (7) is cleaned from the unpleasant odors by being passed over the ion generator (7) and delivered into the tub (2) by means of the outlet (5). The air directed to the additional channel (109) is discharged to the outer environment. Thus, during the odor removal operation, while the ion-laden air is provided to be delivered into the tub (2) by passing a portion of the air inside the air channel (6) over the ion generator (7), a portion of the air is provided to be delivered to the outer environment without ion.

In another embodiment of the present invention, the dishwasher (1) comprises a control unit (11) providing the air inside the tub (2) to be cleaned by means of the ion generator (7) by operating the fan (8) at the end of a certain number of washing cycle predetermined by the producer. Thus, the operation of removing unpleasant odors inside the tub (2) is performed automatically at certain intervals.

In another embodiment of the present invention, the control unit (11) realizes an odor removal program selected by means of the user interface and executed independently of the washing cycle. When the odor removal program is selected by the user, the control unit (11) starts the odor removal operation by operating the fan (8). Thus, the user is presented with an opportunity of removing unpleasant odors inside the tub (2) by starting the odor removal program whenever s/he smells unpleasant odor when s/he opens the door (3).

By means of the present invention (1), unpleasant odors formed by the dishes kept inside the dishwasher (1) for a long time are removed, user inconveniences that may occur for that reason are prevented.

It is to be understood that the present invention is not limited to the embodiments disclosed above and a person skilled in the art can easily introduce different embodiments. These different embodiments should also be considered within the scope of the claims of the present invention, too.

The invention claimed is:

1. A dishwasher, comprising:

a tub wherein items to be washed are placed;

a door providing access into the tub; and a drying and odor removal air channel system including:

a first air channel having a single inlet opening into the tub;

a second air channel having one end connected to the first air channel and another end being an outlet opening into the tub;

a third air channel having one end connected to the first air channel and a second end opening to an outer environment;

an ion generator located inside the second air channel;

a single fan within the drying and odor removal air channel system, the single fan located in the first air channel and adapted to operate during a drying operation and an odor removal operation; and a valve located inside the first air channel after the single fan and directing air to one of the second air channel in a first valve position and the third air channel in a second valve position, the valve in the first valve position directing the air sucked from the single inlet by the single fan to the second air channel having the ion generator during the odor removal operation, and the valve in the second valve position directing the air sucked from the single inlet by the single fan to the third air channel during the drying operation, wherein the single fan provides air circulation during the odor removal operation by sucking air from the single inlet of the first air channel and directing the air from the single inlet through the first air channel, then the valve, then the second air channel, and then the outlet of the second air channel opening into the tub, wherein the air passed over the ion generator during the odor removal operation is not discharged into the outer environment, and wherein the single fan provides air discharge during the drying operation by sucking the air from the single inlet of the first air channel and directing the air from the single inlet through the first air channel, then the valve, then the third air channel, and then the second end of the third air channel opening to the outer environment, wherein the air discharged to the outer environment during the drying operation is not passed over the ion generator.

2. The dishwasher as in claim 1, wherein the first air channel is located on the door.

3. The dishwasher as in claim 1, wherein the first air channel is located on a side wall of the tub.

4. The dishwasher as in claim 1, wherein the single fan is located between the single inlet and the ion generator.

5. The dishwasher as in claim 1, wherein the single fan is placed on the single inlet of the first air channel.

6. The dishwasher as in claim 1, further comprising a control unit providing for the air inside the tub to be cleaned by the ion generator by operating the single fan at the end of a certain number of washing cycles predetermined by a producer.

7. The dishwasher as in claim 1, wherein a control unit provides for selection by a user interface of the odor removal operation independently of the washing cycle.

8. The dishwasher as in claim 2, wherein the single fan is located between the single inlet and the ion generator.

9. The dishwasher as in claim 2, wherein the single fan is placed on the single inlet of the first air channel.

10. The dishwasher as in claim 2, further comprising a control unit providing for the air inside the tub to be cleaned by the ion generator by operating the single fan at the end of a certain number of washing cycles predetermined by a producer.

11. The dishwasher as in claim 3, wherein the single fan is located between the single inlet and the ion generator.

12. The dishwasher as in claim 3, wherein the single fan is placed on the single inlet of the first air channel.

13. The dishwasher as in claim 3, further comprising a control unit providing for the air inside the tub to be cleaned by the ion generator by operating the single fan at the end of a certain number of washing cycles predetermined by a producer.

* * * * *